US006769247B2

(12) United States Patent
Watanabe et al.

(10) Patent No.: US 6,769,247 B2
(45) Date of Patent: Aug. 3, 2004

(54) EXHAUST GAS VALVE DEVICE IN INTERNAL COMBUSTION ENGINE

(75) Inventors: Norihito Watanabe, Wako (JP); Yasuyuki Miyahara, Wako (JP); Tadashi Sato, Wako (JP); Masao Komine, Wako (JP); Kenichi Ohmori, Wako (JP); Kenji Abe, Wako (JP); Tetsuo Endo, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/231,476

(22) Filed: Aug. 30, 2002

(65) Prior Publication Data

US 2003/0061804 A1 Apr. 3, 2003

(30) Foreign Application Priority Data

Sep. 3, 2001 (JP) ..... 2001-265750

(51) Int. Cl.[7] ..... F01N 7/00

(52) U.S. Cl. ..... 60/324; 60/288; 251/214; 251/355; 251/368; 384/286

(58) Field of Search ..... 60/288, 324, 274; 251/214, 355, 368; 384/286, 289, 292; 428/551, 553

(56) References Cited

U.S. PATENT DOCUMENTS 3,575,381 A * 4/1971 Gilmore ..... 251/368
4,103,866 A * 8/1978 Robinson ..... 251/368
4,318,422 A * 3/1982 Nakanishi et al. ..... 251/355
5,251,874 A * 10/1993 Coleman et al. ..... 251/214
5,484,662 A * 1/1996 Rao ..... 428/553
5,516,213 A * 5/1996 Moriyama et al. ..... 384/292
5,630,571 A * 5/1997 Kipp et al. ..... 251/214
6,273,058 B1 * 8/2001 Wagner ..... 60/324

FOREIGN PATENT DOCUMENTS

JP 11-166428 6/1999

* cited by examiner

*Primary Examiner*—Thomas Denion
*Assistant Examiner*—Tu M. Nguyen
(74) *Attorney, Agent, or Firm*—Armstrong, Kratz, Quintos Hanson & Brooks, LLP

(57) ABSTRACT

An exhaust gas valve device in an internal combustion engine, including a first bearing member mounted between a valve shaft and a valve body with one end of the valve shaft turnably fitted into the first bearing member, a second bearing member mounted between the valve shaft and the valve body with the other end of the valve shaft turnably passed through the second bearing member, and an actuator connected to the other end of the valve shaft protruding from the second bearing member. The valve body, the valve shaft and the first and second bearing members are formed of metal materials having equivalent thermal expansion coefficients; the first and second bearing members are press-fitted into said valve body; and a skin of a graphite-based solid lubricant is formed on a surface of the valve shaft in regions corresponding to the first and second bearing members. The concentricity accuracy of the pair of bearing members supporting the opposite ends of the valve shaft is enhanced, while avoiding an increase in the number of parts, thereby preventing the generation of noise and reducing the friction.

5 Claims, 7 Drawing Sheets

EXHAUST GAS VALVE DEVICE IN INTERNAL COMBUSTION ENGINE

BACKGROUND OF THE INVENTION

1. Field of the Invention

The present invention relates to an exhaust gas valve device in an internal combustion engine.

2. Description of the Related Art

A conventional exhaust gas valve device is described, for example, in Japanese Patent Application Laid-open No. 11-166428.

Some of the conventional exhaust gas valve devices include a bearing member made of a carbon material fixed to a valve body in order to prevent the generation of noise to as a result of the turning of the valve shaft and to reduce friction.

When the carbon material is used for the bearing member, however, the concentric accuracy of a pair of bearing members made of the carbon material cannot be enhanced as a result of a difference in the thermal expansion coefficient between a metal material for forming the valve body and the carbon material and/or as a result of the fact that the bearing member made of the carbon material is unsuitable for fixing to the valve body by direct press-fitting. Also, a separate part is required for fixing the bearing member to the valve body, resulting in an increase in the number of parts.

SUMMARY OF THE INVENTION

An object of the present invention to provide an exhaust gas valve device in an internal combustion engine which can enhance the concentricity accuracy of the pair of bearing members for supporting opposite ends of the valve shaft, to thereby effectively prevent the generation of noise and to effectively reduce the friction.

To achieve the above object, according to the present invention, there is provided an exhaust gas valve device in an internal combustion engine, comprising: a valve body provided in an exhaust system in the internal combustion engine and defining a flow passage through which an exhaust gas flows, a valve shaft mounted to traverse the flow passage, a valve member mounted to the valve shaft within the valve body, a bottomed cylindrical first bearing member mounted between the valve shaft and the valve body with one end of the valve shaft turnably fitted into the first bearing member, a cylindrical second bearing member mounted between the valve shaft and the valve body with the other end of the valve shaft passed through the second bearing member, and an actuator connected to the other end of the valve shaft protruding from the second bearing member for driving the valve shaft to turn.

The valve body, the valve shaft and the first and second bearing members are formed of metal materials having equivalent thermal expansion coefficients. The first and second bearing members are press-fitted into the valve body. A skin of a graphite-based solid lubricant is formed on a surface of the valve shaft in regions corresponding to the first and second bearing members.

With this arrangement, the first and second bearing members are formed of the metal materials having the thermal expansion coefficient equivalent to the metal material for forming the valve body. Therefore, even if the first and second bearing members are press-fitted directly into the valve body, there is not a possibility that the first and second bearing members are removed from the valve body as a result of a change in temperature. Thus, the first and second bearing members can be fixed to the valve body, while avoiding an increase in the number of parts, whereby the concentricity accuracy of the pair of bearing members can be enhanced. In addition, because the valve shaft is also formed of the metal material having the thermal expansion coefficient equivalent to that of the valve body, clearances between the valve shaft and the bearing members can be minimized. Moreover, because the skin of the graphite-based solid lubricant is formed on the surface of the valve shaft in the regions corresponding to the first and second bearing members, the slidability of the valve shaft at a high temperature can be improved, whereby the generation of noise can be effectively prevented and the friction can be effectively reduced, in cooperation with the enhancement in concentricity accuracy. Thus, it is possible to improve the durability of the exhaust gas valve device.

An expansion graphite ground packing may be interposed between the valve shaft and the second bearing member or a ring-shaped member which is fixed to the second bearing member to surround the valve shaft.

With this arrangement, the leakage of exhaust gas from the periphery of the valve shaft at a high temperature can be prevented by the expansion graphite ground packing having a high heat resistance particularly in an atmosphere basically containing no oxygen, as in an exhaust gas from the internal combustion engine. Moreover, because the expansion graphite ground packing has a low shape restorability, when the deflection of the valve shaft is large, there is a possibility that the sealability of the expansion graphite ground packing is deteriorated. In the present invention, however, the concentricity accuracy of the pair of bearing members can be increased, and the clearances between the valve shaft and the bearing members can be minimized, whereby the deflection of the valve shaft can be suppressed to a smaller level. Therefore, it is possible to maintain the sealability of the expansion graphite ground packing at a high level.

BRIEF DESCRIPTION OF THE DRAWINGS

FIGS. 1 to 5 show a first embodiment of the present invention, in which FIG. 1 is a view showing an intake system and an exhaust system in an internal combustion engine;

FIG. 2 is a side view of an exhaust gas valve device and an HC adsorbing device;

FIG. 3 is a vertical sectional view of the exhaust gas valve device and the HC adsorbing FIG. 4 is a sectional view taken along a line 4—4 in FIG. 2;

FIG. 5 is an enlarged view of an essential portion of FIG. 4;

DETAILED DESCRIPTION OF THE PREFERRED EMBODIMENTS

Figure 1:
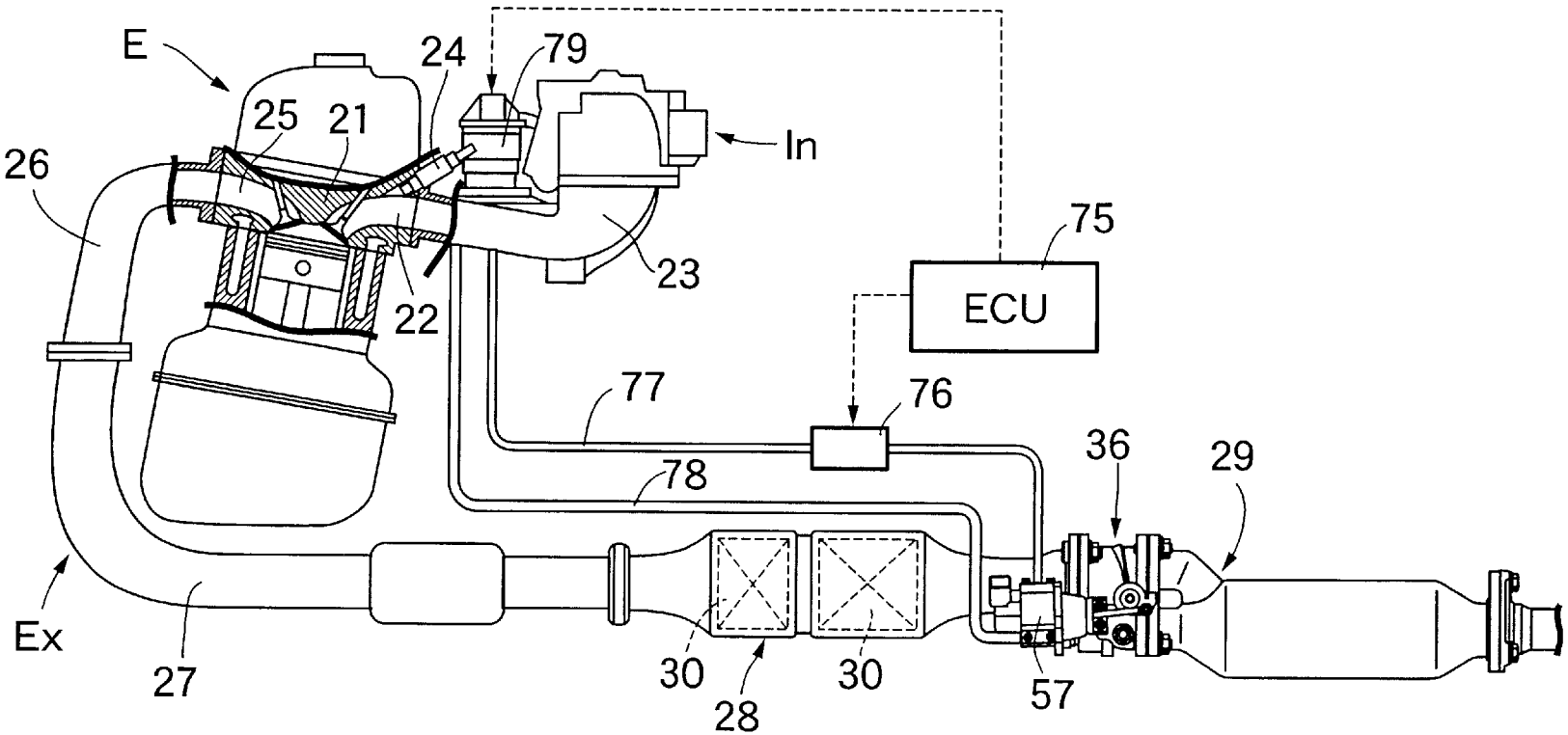

Referring first to FIG. 1, an intake system In leading to intake ports 22 provided in a cylinder head 21 of an internal combustion engine E of a multi-cylinder type includes an intake manifold 23 connected to the intake ports 22. Fuel injection valves 24 for respective intake ports 22 are mounted in the cylinder head 21. An exhaust system Ex leading to exhaust ports 25 provided in the cylinder head 21 includes an exhaust manifold 26, an exhaust pipe 27, a catalytic converter 28, an exhaust gas valve device 36 and an HC adsorbing device 29 sequentially in the named order from the side of the exhaust ports 25.

A pair of ternary catalysts 30, 30 are accommodated in the catalytic converter 28 at a distance in a direction of flowing of the exhaust gas, and convert toxic substances (hydrocarbons, carbon monoxide and nitrogen compounds) contained in an exhaust gas by a redox reaction in an activated state. Activation of each of the ternary catalysts 30 starts at a predetermined activation-starting temperature (e.g., 100° C.) or more, and is completed when the temperature thereof rises to a completely activating temperature (e.g., 300° C.).

The HC adsorbing device 29 adsorbs hydrocarbon(s) (HC) contained in the exhaust gas within a predetermined time (e.g., 40seconds) in which the ternary catalysts 30, 30 are presumed to reach the activation-starting temperature, thereby preventing the unburned HC from being exhausted into the atmospheric air.

Figure 2:
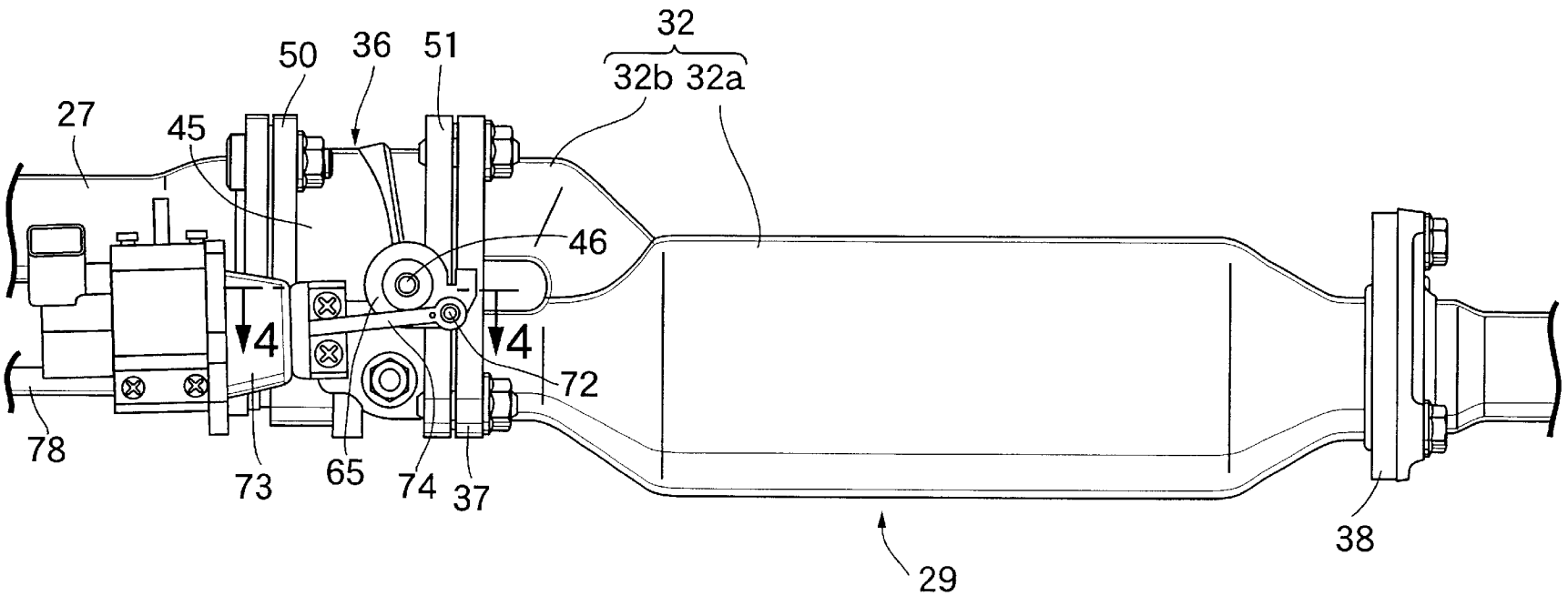
Figure 3:
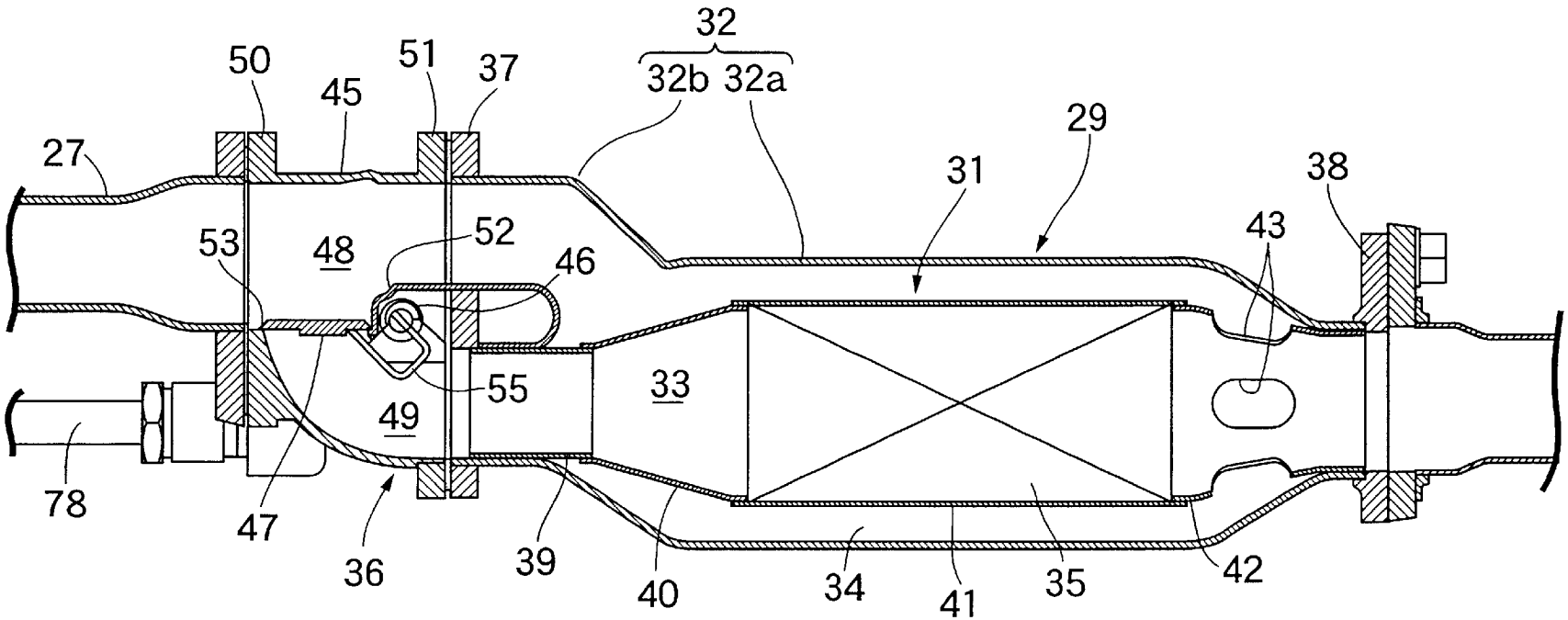

Referring to FIGS. 2 and 3, the HC adsorbing device 29 includes an inner pipe 31 defining an inner passage 33 therein, an outer pipe 32 defining an outer passage 34 between the outer pipe 32 and the inner pipe 31 and surrounding the inner pipe 31, and an HC adsorbent 35 packed in the inner pipe 31 in such a manner that it is disposed at an intermediate portion of the inner passage 33.

The outer pipe 32 includes a rectilinear main pipe portion 32*a* having narrowed down upstream and downstream ends, and a branch pipe portion 32*b* branched from the upstream end of the main pipe portion 32*a*. A common flange 37 is mounted at the upstream ends of the main pipe portion 32*a* and the branch pipe portion 32*b*. A flange 38 is mounted at the downstream end of the main pipe portion 32*a*, i.e., at the downstream end of the outer pipe 32.

The inner pipe 31 is disposed coaxially within the main pipe portion 32*a* of the outer pipe 32, and includes a smaller-diameter straight pipe portion 39 fitted and fixed at the upstream end of the main pipe portion 32*a*, an increased-diameter pipe portion 40 which has a tapered region so that its diameter increases toward its downstream side and which is connected at its upstream end to a downstream end of the smaller-diameter straight pipe portion 39, a larger-diameter straight pipe portion 41 connected at its upper end to a downstream end of the increased-diameter pipe portion 40, and a decreased-diameter pipe portion 42 which has a tapered region so that its diameter decreases toward its downstream side and which is connected at its upstream end to a downstream end of the larger-diameter pipe portion 41. The decreased-diameter pipe portion 42 is fitted and fixed at its downstream end in the downstream end of the main pipe portion 32*a*.

The HC adsorbent 35 is charged within the larger-diameter straight pipe portion 41 of the inner pipe 31. The exhaust gas introduced into the inner passage 33 flows through the HC adsorbent 35. The HC adsorbent 35 is in the form of a honeycomb core made of a metal (e.g., a stainless steel) carrying zeolite on its surface, and includes a large number of internal bores extending therethrough along the inner passage 33. When the exhaust gas introduced into the inner passage 33 flows through the internal bores in the HC adsorbent 35, HC and moisture contained in the exhaust gas are adsorbed to the zeolite.

The zeolite has a high heat resistance, adsorbs HC when the temperature of the zeolite is less than a predetermined desorption-starting temperature (e.g., 100° C.), starts to desorb the adsorbed HC when the temperature of the zeolite reaches the desorption-starting temperature or higher, and that the adsorbed HC is desorbed completely when the temperature of the zeolite reaches a predetermined completely-desorbing temperature (e.g., 200° C.).

A plurality of communication bores 43 are provided in the downstream end of the inner pipe 31, more specifically, in a sidewall of the decreased-diameter pipe portion 42. The exhaust gas having flowed through the outer passage 34 flows through the communication bores 43 into the downstream end of the inner passage 33.

Figure 4:
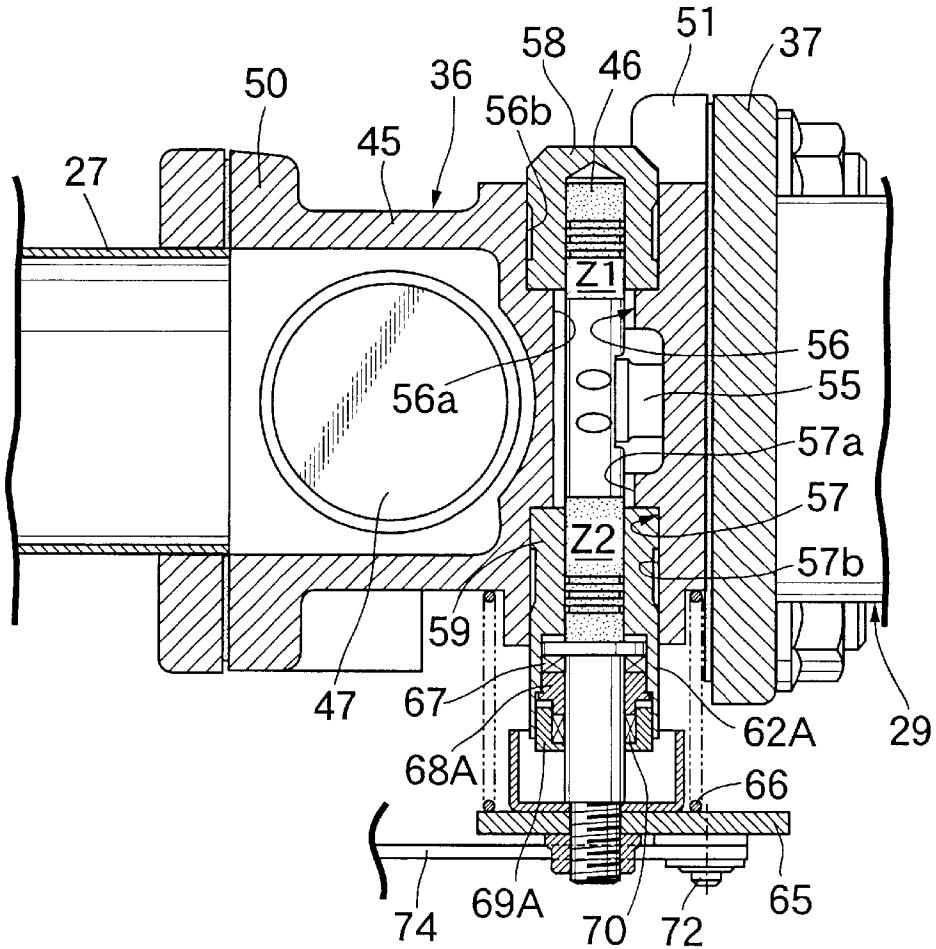

Referring also to FIG. 4, after the starting of the internal combustion engine E, the exhaust gas valve device 36 guides the exhaust gas flow from the catalytic converter 28 toward the inner passage 33 in order to prevent the unburned HC from being discharged outside due to that the catalysts within the catalytic converter 28 do not yet reach the activating temperature; and when a given time has elapsed after the starting of the internal combustion engine E, the exhaust gas valve device 36 changes the course of the exhaust gas flow from the catalytic converter 28 toward the outer passage 34.

The exhaust gas valve device 36 includes a valve body 45, a valve shaft 46 turnably carried on the valve body 45, and a valve member 47 mounted to the valve shaft 46 within the valve body 45.

The valve body 45 and the valve shaft 46 are formed of metal materials having equivalent expansion coefficients. For example, the valve body 45 is formed of an austenitic stainless steel, while the valve shaft 46 is formed of an austenitic heat-resistant steel.

The valve body 45 defines a main flow passage 48 having an upstream end leading to a downstream end of the catalytic converter 28 and a downstream end leading to the upstream end of the outer passage 34, and a bypass flow passage 49 branched from an intermediate portion of the main flow passage 48 and having a downstream end leading to the upstream end of the inner passage 33. Further, an upstream flange portion 50 is integrally provided on the valve body 45 in a manner such that an upstream end of the main flow passage 48 opens into the upstream flange portion 50, and is fastened to the catalytic converter 28. A downstream flange portion 51 is provided on the valve body 45 with downstream ends of the main flow passage 48 and the bypass flow passage 49 open thereinto independently from each other, and is fastened to the flange 37 of the outer pipe 32.

An annular valve seat 52 is provided on an inner surface of the valve body 45 in the middle of the main flow passage 48 at a location downstream from a position where the bypass flow passage 49 is branched. An annular valve seat 53 is provided on the valve body 45 at a location where the upstream end of the bypass flow passage 49 opens into the main flow passage 48. The valve member 47 is formed into a disk shape so that it is alternately switched over between a state in which its peripheral edge is seated on the valve seat 52 to shut off the main flow passage 48 and to open the bypass flow passage 49, and a state in which its peripheral edge is seated on the valve seat 53 to shut off the bypass flow passage 49 and to open the main flow passage 48.

Figure 5:
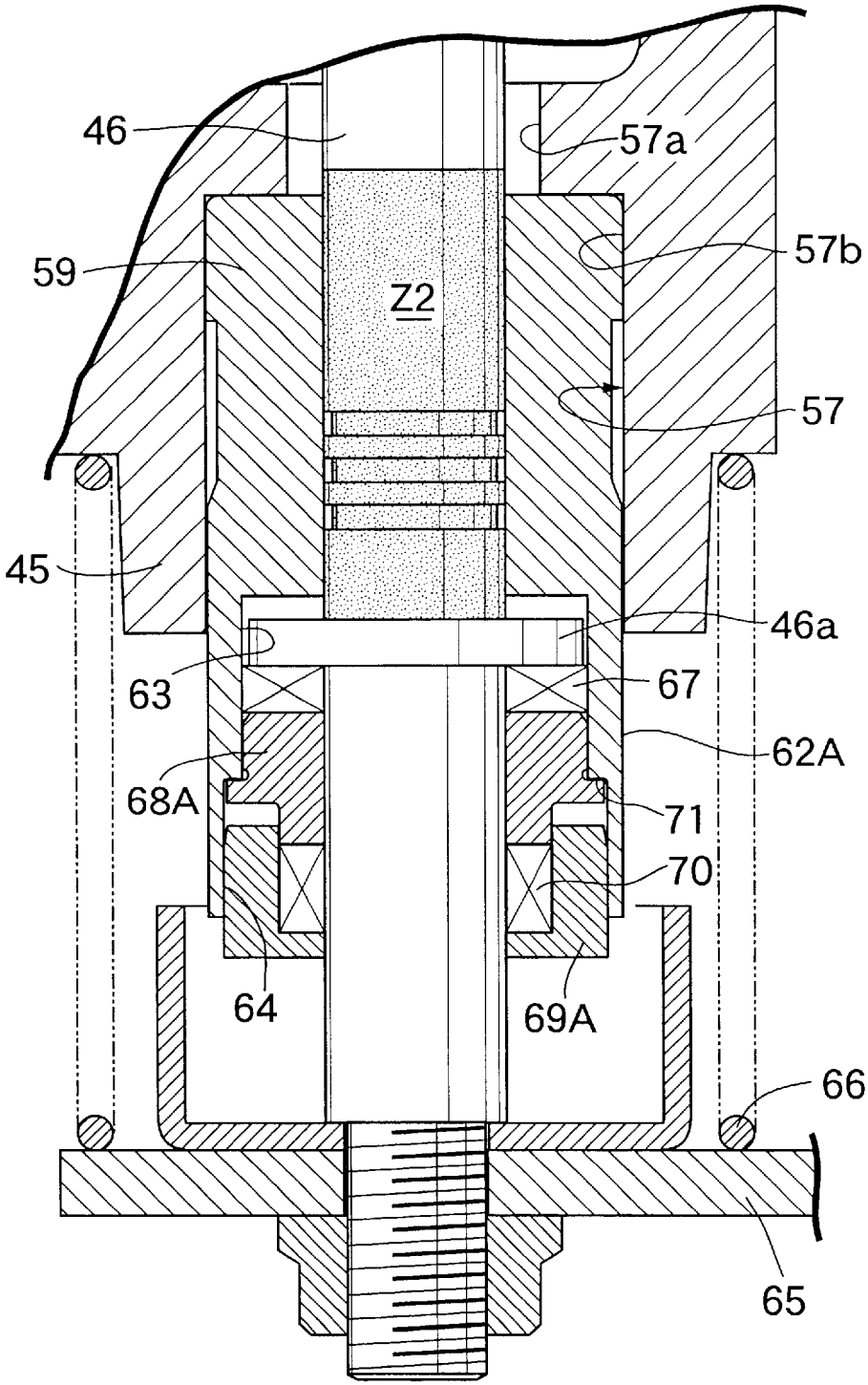

Further, referring also to FIG. 5, the valve shaft 46 is disposed to traverse a region of the bypass flow pass 49 closer to the main flow pass 48. The valve member 47 is fastened to an arm 55 fastened to the valve shaft 46.

Support bores 56 and 57 are provided coaxially with the valve shaft 46 in a region of the valve body 45 corresponding to the valve shaft 46, to extend between the inside and outside of the valve body 45. Each of the support bores 56 and 57 comprises a smaller-diameter bore portion 56*a*, 57*a* on the side of the bypass flow passage 49, and a larger-diameter bore portion 56*a*, 57*a* coaxially connected to the smaller-diameter bore portion 56*b*, 57*b* with a difference in height left therebetween.

The valve shaft 46 is turnably carried on the valve body 45 on opposite sides of the bypass flow passage 49 with first and second bearing members 58 and 59 interposed therebetween. The first and second bearing members 58 and 59 are formed of a metal material such as an austenitic stainless steel having a thermal expansion coefficient equivalent to those of the valve body 45 and the valve shaft 46.

The bottomed cylindrical first bearing member 58 with its outer end closed is press-fitted into the larger-diameter bore portion 56*b* of the support bore 56. The cylindrical second bearing member 59 is press-fitted into the larger-diameter bore portion 57*b* of the support bore 57. One end of the valve shaft 46 is turnably fitted into the first bearing member 58, and the other end of the valve shaft 46 is turnably passed through the second bearing member 59.

A cylindrical stuffing box 62A is integrally provided on an outer periphery of an outer end of the second bearing member 59, and protrudes outwards from the outer surface of the valve body 45, while surrounding the valve shaft 46. A smaller-diameter bore 63 and a larger-diameter bore 64 having a diameter larger than that of the smaller-diameter bore 63 are coaxially provided within the stuffing box 62A in the named order from the side of the second bearing member 59. In addition, a collar portion 46*a* is provided at an intermediate portion of the valve shaft 46 passing through the second bearing member 59, so that its outer peripheral surface is opposed to an inner surface of the smaller-diameter bore 63.

The other end of the valve shaft 46 protrudes outwards from the stuffing box 62A. A disk-shaped link plate 65 protruding radially outwards from the outer peripheral surface of the valve shaft 46 is secured to the other end of the valve shaft 46. A coil-shaped return spring 66 is mounted between the link plate 65 and the valve body 45, and adapted to urge the link plate 65 and the valve shaft 46 to turn in a direction causing the valve member 47 to be seated on the valve seat 53 to shut off the bypass flow passage 49.

A ring-shaped calcined graphite packing 67 is interposed between the stuffing box 62A and the valve shaft 46 outside the collar 46*a*, and inserted into the smaller-diameter bore 63 to abut against an outer surface of the collar 46*a*. A first packing retainer 68A formed into a ring shape to sandwich the calcined graphite packing 67 between the packing retainer 68A and the collar 46*a*, is press-fitted into the smaller-diameter bore 63, until it abuts against an annular step 71 between the smaller-diameter bore 63 and the larger-diameter bore 64.

An expansion graphite ground packing 70 is sandwiched between the first packing retainer 68A and a second packing retainer 69A as a ring-shaped member fixed to the second bearing member 59 to surround the valve shaft 46. The second packing retainer 69A is press-fitted into the larger-diameter bore 64 in the stuffing box 62A, whereby it is fixed to the second bearing member 59 fixed to the valve body 45. The expansion graphite ground packing 70 is compressed axially between the second packing retainer 69A and the first packing retainer 68A, so that its outer surface is brought into close contact with the entire inner surface of the second packing retainer 69A, and its inner surface is brought into close contact with the entire outer surface of the valve shaft 46.

On the other hand, the calcined graphite packing 67 is sandwiched between the collar 46*a* of the valve shaft 46 and the first packing retainer 68A by a thrust load acting on the valve shaft 46, so that entire opposed surfaces of the calcined graphite packing 67 and the collar 46*a* are in close contact with each other, and entire opposed surfaces of the calcined graphite packing 67 and the first packing retainer 68A are in close contact with each other.

A skin of a graphite-based solid lubricant is formed on surfaces of regions Z 1 and Z2 (regions indicated by dots in FIGS. 4 and 5) of the valve shaft 46 corresponding to the first and second bearing members 58 and 59.

To form the skin, for example, a graphite-based solid lubricant is used, which is commercially available as a mixture of graphite which is a solid lubricant, an organic titanate which is a bound resin, and cyclohexane which is a base solvent. The graphite-based solid lubricant is applied to the regions Z1 and Z2 of the valve shaft 46 and then dried, whereby the skin is formed on the surface of the valve shaft 46 in the regions Z1 and Z2.

A connecting pin 72 is embedded in the link plate 65 at a location eccentric from an axis of the valve shaft 46. A rod 74 of a negative pressure-type actuator 73 for turning the valve shaft 46 against a spring force of the return spring 66, is connected to the connecting pin 72.

The actuator 73 is operated by a negative pressure generated as a power source in the intake system In of the internal combustion engine E, and is connected to the intake manifold 23 through a negative pressure control valve 76 which is opened and closed by an ECU 75, and through a negative pressure conduit 77, as shown in FIG. 1. When the negative pressure control valve 76 is opened, an intake negative pressure is introduced into the actuator 73, whereby the rod 74 is operated axially to turn the link plate 65. More specifically, the actuator 73 is operated at a time point within a given time after the starting of the internal combustion engine E, thereby rotating the valve shaft 46 to a position to open the bypass flow passage 49 and to close the main flow passage 48. In addition to the operation of the actuator 73 at a time point within the given time, the actuator 73 is also controlled in accordance with a detected operative state of the internal combustion engine E.

On the other hand, a circulation line 78 leading to the bypass flow passage 49 is connected at one end thereof to the valve body 45, and at the other end thereof to the intake manifold 23. Moreover, a circulation control valve 79 is incorporated in the circulation line 78. The ECU 75 controls the operation of the circulation control valve 79 so that the HC desorbed from the HC adsorbent 35 is returned toward the intake manifold 23.

The operation of the first embodiment will be described below. In the exhaust gas valve device 36, the first and second bearing members 58 and 59 mounted between the valve shaft 46 and the valve body 45 are press-fitted into the valve body 45, and moreover are formed of the metal material having the thermal expansion coefficient equivalent to that of the metal material for forming the valve body 45.

Therefore, even if the first and second bearing members 58 and 59 are press-fitted directly into the valve body 45, there is no possibility that the first and second bearing members 58 and 59 are removed from the valve body 45 due to a change in temperature. Thus, the first and second bearing members 58 and 59 can be fixed to the valve body 45 while avoiding an increase in the number of parts, whereby the concentricity accuracy of the first and second bearing members 58 and 59 can be enhanced.

In addition, because the valve shaft 46 is also formed of the metal material having the thermal expansion coefficient equivalent to that of the valve body 45, clearances between the valve shaft 46 and the first and second bearing members 58 and 59 can be minimized.

Moreover, because the skin of the graphite-based solid lubricant having a heat resistance is formed on the surface of the valve shaft 46 in the regions Z1 and Z2 corresponding to the first and second bearing members 58 and 59, the slidability of the valve shaft 46 at a high temperature can be improved, whereby the generation of noise can be effectively prevented and the friction can be effectively reduced, in cooperation with the enhancement in concentricity accuracy. Thus, it is possible to improve the durability of the exhaust gas valve device 36.

Further, because the expansion graphite ground packing 70 is interposed between the valve shaft 46 and the second packing retainer 69A fixed to the second bearing member 59 to surround the valve shaft 46, the leakage of the exhaust gas from the periphery of the valve shaft 46 at a high temperature can be prevented by the expansion graphite ground packing 70 having the high heat resistance particularly in an atmosphere basically containing no oxygen, as in the exhaust gas from the internal combustion engine E.

Moreover, because the expansion graphite ground packing has a low shape restorability, when the deflection of the valve shaft is large, there is a possibility that the sealability of the expansion graphite ground packing is deteriorated. However, the concentricity accuracy of the first and second bearing members 58 and 59 can be increased, and the clearances between the valve shaft 46 and the bearing members 58 and 59 can be minimized, whereby the deflection of the valve shaft 46 can be suppressed to a smaller level. Therefore, it is possible to maintain the sealability of the expansion graphite ground packing 70 at a high level.

A thrust load is applied from the valve shaft 46 to the calcined graphite packing 67 sandwiched between the collar 46*a* of the valve shaft 46 and the first packing retainer 58A, and the calcined graphite packing 67 performs the sealing between the valve shaft 46 and the stuffing box 62A by a thrust surface pressure resulting from the thrust load, whereby the double sealing is achieved by the expansion graphite ground packing 70 and the calcined graphite packing 67.

Figure 6:
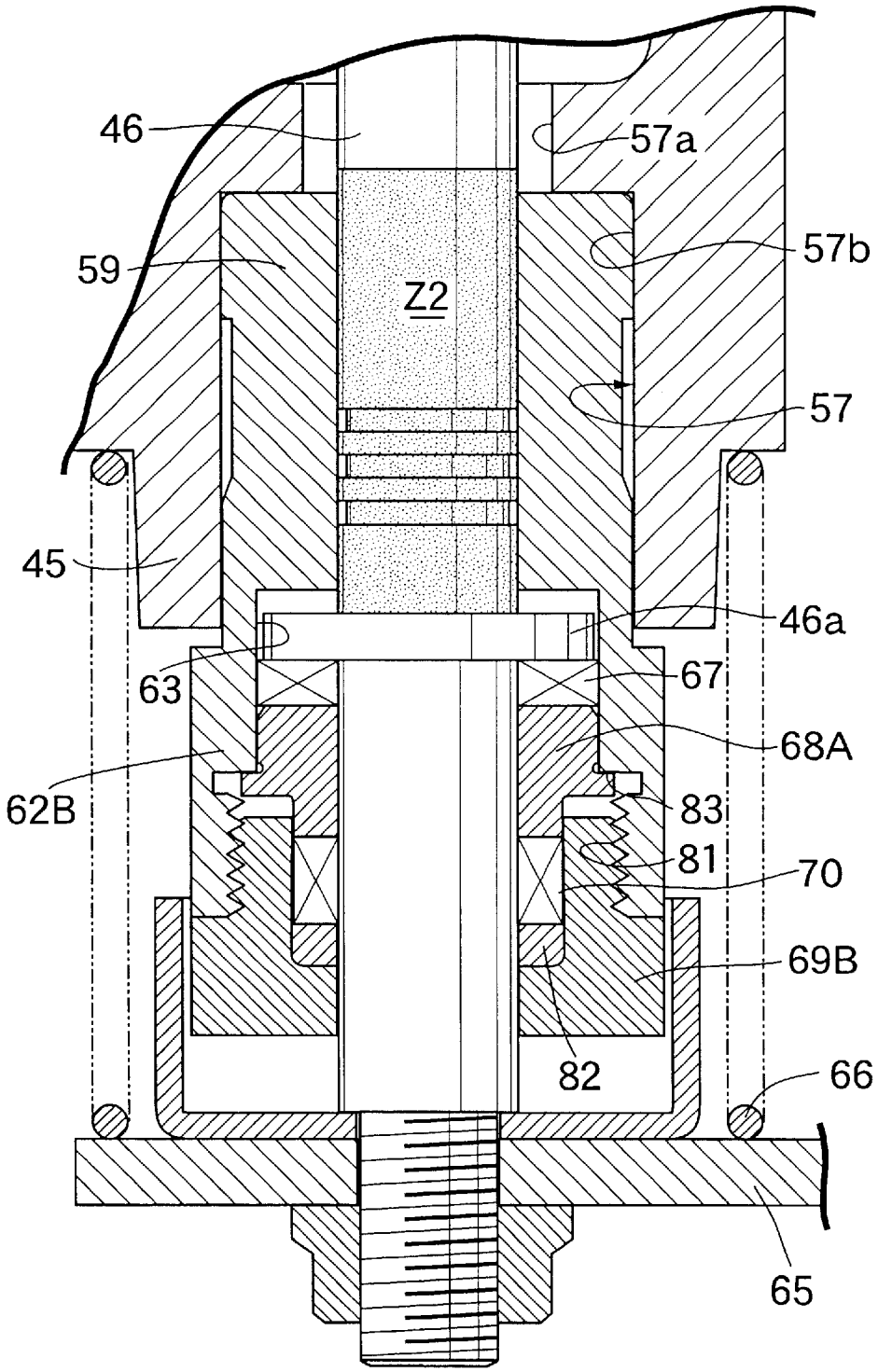
FIG. 6 is a sectional view similar to FIG. 5 but showing a second embodiment of the present invention.

FIG. 6 shows a second embodiment of the present invention, wherein portions or components corresponding to those in the first embodiment are designated by the same reference numerals.

A cylindrical second bearing member 59 is press-fitted into a larger-diameter bore portion 57*b* of a support bore 57 in a valve body 45. A cylindrical stuffing box 62B is integrally provided on an outer periphery of an outer end of the second bearing member 59, to protrude outwards from an outer surface of the valve body 45 while surrounding the valve shaft 46.

A smaller-diameter bore 63 and a larger-diameter threaded bore 81 having a diameter larger than that of the smaller-diameter bore 63 are coaxially provided within the stuffing box 62B sequentially in the named order from the side of the second bearing member 59. The other end of the valve shaft 46 protrudes outwards from the stuffing box 62*b*.

A ring-shaped calcined graphite packing 67 is interposed between the stuffing box 62B and the valve shaft 46 outside the collar 46*a* of the valve shaft 46, and inserted into the smaller-diameter bore 63 to abut against an outer surface of the collar 46*a*. A first packing retainer 68A formed into a ring shape to sandwich the calcined graphite packing 67 between the packing retainer 68A and the collar 46*a*, is press-fitted into the smaller-diameter bore 63, until it abuts against an annular step 83 between the smaller-diameter bore 63 and the threaded bore 64.

The expansion graphite ground packing 70 and a washer 82 are sandwiched between the first packing retainer 68A and a second packing retainer 69B as a ring-shaped member fixed to the second bearing member 59 and surrounding the valve shaft 46. The second packing retainer 69B is threadedly fitted into the threaded bore 81 in the stuffing box 62B, whereby it is fixed to the second bearing member 59 fixed to the valve body 45. The washer 82 is interposed between the second packing retainer 69B and the expansion graphite ground packing 70 in order to prevent the expansion graphite ground packing 70 from being twisted due to the rotation of the second packing retainer 69B. The axially compressed expansion graphite ground packing 70 has an outer surface brought into close contact with the entire inner surface of the second packing retainer 69B, and an inner surface brought into close contact with the entire outer surface of the valve shaft 46.

The second embodiment also provides an effect similar to that in the first embodiment.

Figure 7:
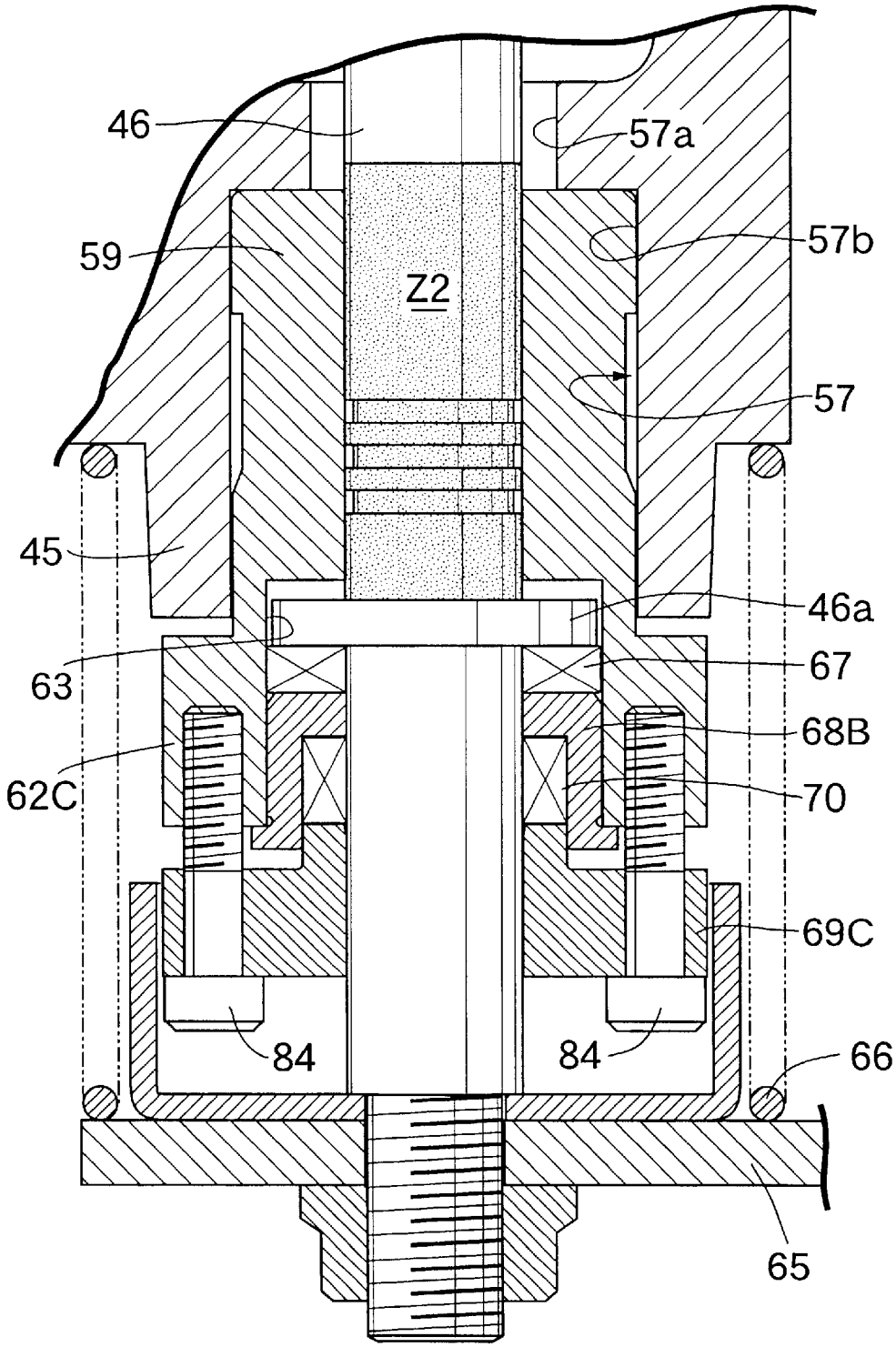
FIG. 7 is a sectional view similar to FIG. 5 but showing a third embodiment of the present invention.

FIG. 7 shows a third embodiment of the present invention, wherein portions or components corresponding to those in the first and second embodiments are designated by the same reference numerals.

A cylindrical second bearing member 59 is press-fitted into a larger-diameter bore portion 57*b* of a support bore 57 in a valve body 45. A cylindrical stuffing box 62C is integrally provided on an outer periphery of an outer end of the second bearing member 59, to protrude outwards from an outer surface of the valve body 45 while surrounding the valve shaft 46.

A ring-shaped calcined graphite packing 67 is interposed between the stuffing box 62C and the valve shaft 46 outside the collar 46*a* of the valve shaft 46 and inserted into the stuffing box 62C to abut against an outer surface of the collar 46*a*. A first packing retainer 68B as a ring-shaped member fixed to the second bearing member 59 and surrounding the valve shaft 46 is press-fitted into the smaller-diameter bore 63, until it abuts against the stuffing box 62C, so that the calcined graphite packing 67 is sandwiched between the first packing retainer 68B and the collar 46*a*.

The expansion graphite ground packing 70 is sandwiched between the first packing retainer 68B and a second packing retainer 69C fastened to the stuffing box 62C by a plurality of bolts 84. The expansion graphite ground packing 70 axially compressed between the first and second packing retainers 68B and 69C by tightening the bolts 84, has an outer surface brought into close contact with the entire inner surface of the first packing retainer 68B, and an inner surface brought into close contact with the entire outer surface of the valve shaft 46.

Even according to the third embodiment, an effect similar to that in the first embodiment can be provided.

Although the embodiments of the present invention have been described, it will be understood that the present invention is not limited to the above-described embodiments, and various modifications in design may be made without departing the scope of the invention defined in the claims.

For example, in each of the above-described embodiments, the calcined graphite packing 67 is interposed between the valve shaft 46 and each of the stuffing boxes 62A to 62C integrally provided on the second bearing member 59, but the present invention is also applicable to an exhaust gas valve device in which the calcined graphite packing 67 is omitted, and the sealing is performed by only an expansion graphite ground packing 70.

What is claimed is:

1. An exhaust gas valve device in an internal combustion engine, said exhaust gas valve device being disposed to change over the course of an exhaust gas flow between a plurality of exhaust gas passages of an exhaust system located downstream of said exhaust gas valve device, said exhaust gas valve device comprising:

a valve body provided in said exhaust system in the internal combustion engine and defining a flow passage through which the exhaust gas flows;

a valve shaft mounted traverse to said flow passage;

a valve member mounted to said valve shaft within said valve body;

a bottomed cylindrical first bearing member mounted between said valve shaft and said valve body with one end of said valve shaft turnably fitted into said first bearing member;

a cylindrical second bearing member mounted between said valve shaft and said valve body with the other end of said valve shaft passing through said second bearing member; and an actuator connected to the other end of said valve shaft protruding from said second bearing member for driving said valve shaft to turn, wherein said valve body, said valve shaft and said first and second bearing members are each formed of a form of steel having equivalent thermal expansion coefficients;

wherein said first and second bearing members are press-fitted into said valve body; and wherein a skin of a graphite-based solid lubricant is formed by coating on a surface of said valve shaft in regions corresponding to said first and second bearing members.

2. The exhaust gas valve device according to claim 1, further including an expansion graphite ground packing interposed between said valve shaft and said second bearing member or a ring-shaped member which is fixed to said second bearing member to surround said valve shaft.

3. The exhaust gas valve device according to claim 1, wherein said valve shaft is formed of austenitic heat-resistant steel.

4. The exhaust gas valve device according to claim 1, wherein said first and second bearing member and said valve body are formed of austenitic stainless steel.

5. The exhaust gas valve device according to claim 1, wherein said second bearing member has a bore which opens toward outside, and said expansion graphite ground packing is disposed inside said bore.

* * * * *